United States Patent [19]

Compton

[11] Patent Number: 4,961,287

[45] Date of Patent: Oct. 9, 1990

[54] WOOD JOINTER AND PLANER BLADE SHARPENING HOLDER

[76] Inventor: Lawrence T. Compton, R.R. 1 Box 77, Nokomis, Ill. 62075

[21] Appl. No.: 399,889

[22] Filed: Aug. 24, 1989

[51] Int. Cl.[5] ..... B24B 7/00

[52] U.S. Cl. ..... 51/74 BS; 51/109 BS; 51/218 R; 51/218 P

[58] Field of Search ..... 51/74 BS, 109 BS, 92 R, 51/123, 92 BS, 231, 122, 121, 125, 217 P, 221 BS, 246, 247, 224, 230, 285, 56 R, 218 R, 218 P, 216 P, 102, 128; 76/82, 82.1, 82.2

[56] References Cited

U.S. PATENT DOCUMENTS 2,782,570 2/1957 Ische ..... 51/92 R 3,181,283 5/1965 Tuttle ..... 51/218 R

*Primary Examiner*—Frederick R. Schmidt

*Assistant Examiner*—M. Rachoba

[57] ABSTRACT

A device for low-cost and convenient sharpening of wood jointer and planer blades or knives. The device comprises a rectangular block of sufficient thickness to embody an angled kerf for holding the blade or knife and thumbscrews to turn up against the blade or knife to hold it in place, the block with the blade or knife inserted to lay flat against the bed of a conventional workshop table saw in an inverted position, a stone grinding wheel to be installed on the saw arbor, the grinding stone to engage the surface of the blade or knife to be sharpened, an elongated guide to be installed on the underside of the block to engage the miter slot in the bed of the table saw to guide the blade or knife to be sharpened along its entire length while in contact with the stone griding wheel, operator to employ repeated reciprocal movements of the block and blade or knife to be sharpened, gradual raising of the stone grinding wheel arbor until visual inspection of object to be sharpened has been ground uniformly over its entire length.

1 Claim, 1 Drawing Sheet

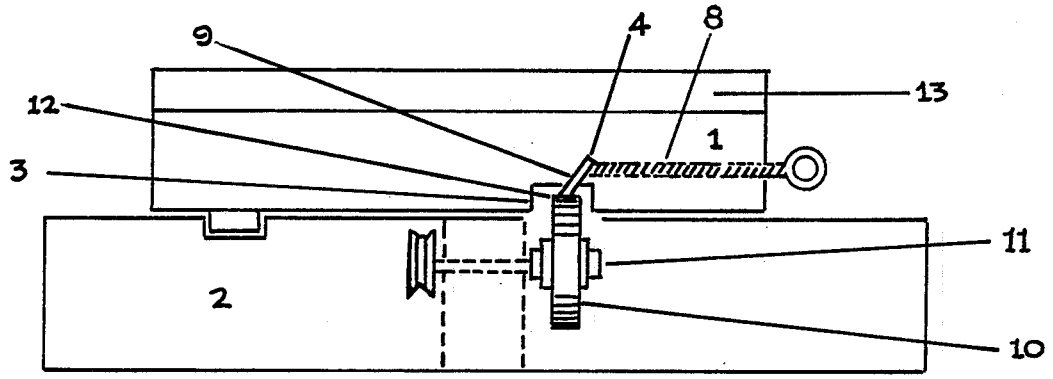
FIGURE 2
FIGURE 1
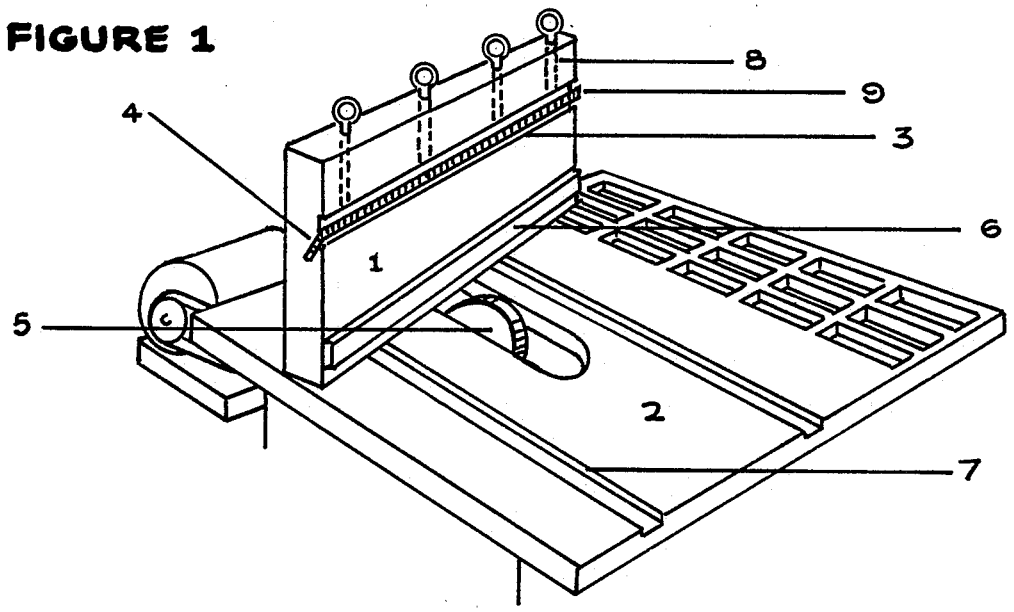
FIGURE 3
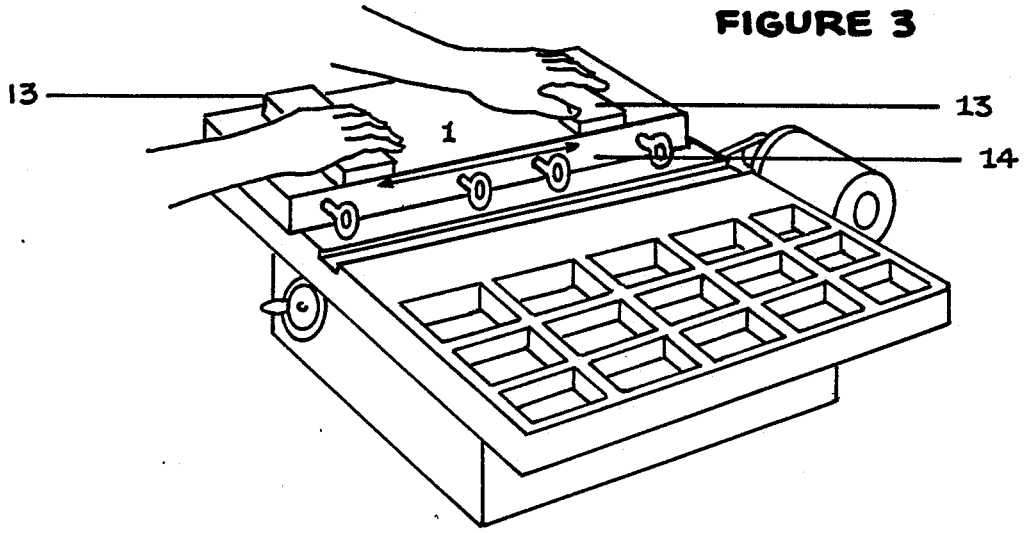

WOOD JOINTER AND PLANER BLADE SHARPENING HOLDER

BACKGROUND OF THE INVENTION

This invention relates to an improvement in sharpening planer and wood jointer blades involving a blade holding device used together with a conventional table saw mechanism but equipped with a grinding wheel instead of a saw in the saw arbor.

Present day methods of sharpening planer blades are based on long-established patents and generally involve either the use of a milling machine or a sharpening device attached to the planer itself. For the home workshop, these methods of sharpening blades are costly and inconvenient.

The present invention teaches the use of an inexpensive blade holding block equipped with a tracking guide which moves the blade to be sharpened along the face of the grinding wheel while maintaining the correct angle of sharpening and doing this along the entire length of the blade to be sharpened.

Present day automatic grinders generally employ a grinding wheel which travels the length of the blade to be sharpened and at a right angle to the blade. These are variations of the M. W. Palmer planter knife grinder, U. S. Pat. No. 267,579, Nov. 14, 1882, and H. Leverentz's planing machine attachment, U. S. Pat. No. 316,156, Apr. 21, 1885.

SUMMARY OF THE INvENTION

The present invention discloses a rectangular block of sufficient length to hold common planer blades in position for sharpening on a grinding wheel installed in a common woodworking table saw. The block is of sufficient width for a long narrow guide extending down from its underside to engage the longitudinal miter slot in the bed of the table saw. The block may be made of plastic, wood or metal. On the operational underside and well to the right there is an angled kerf which is the receptacle for the planer blade, the angle to be 40 degrees to the block, more or less.

To hold the planer blade firmly while sharpening is being done, a number of thumbscrews installed in the right edge of the block are turned in and are tightened against the blade to hold it when it is in position for sharpening.

A relief slot of undetermined depth but 3/32' deep, more or less, and 1 inch, more or less, wide is built into the block to extend to either side of the kerf.

To sharpen a planer blade, the blade is first placed into the holder with the edge to be sharpened on a plane with the underside. Thumbscrews tighten it securely in place. Next, the holder block is placed on the bed of the table saw with the blade to be sharpened on the underside where it will engage with the grinding wheel, and with the guide of the holder riding in the miter slot of the saw.

To operate, first make sure that the grinding wheel is adjusted at 90 degrees to the bed of the saw.

Then the saw motor is turned on and raised carefully until it slightly engages the blade to be sharpened. The operator grips the block and pushes it the full length of the planer blade being sharpened. The operator then gradually raises the grinder wheel as he repeats pushing the block back and forth the entire length of the planer blade. He repeats this until visual inspection indicates the entire length of the planer blade has been ground to uniform sharpness. During this procedure, care is taken not to overheat the planer blade to the point it turns bluish in color as this will take the temper out of the blade. For added convenience of the operator, though not required, hand gripping blocks are installed on the operational upper side of the block.

BRIEF DESCRIPTION OF DRAWINGS

FIG. 1 is a three-quarter view of the planer blade sharpening holder resting on its left edge on top of the bed of a conventional table saw with the circular saw blade replaced by a stone grinding wheel.

FIG. 2 is an end view of the planer blade sharpening holder laying flat on top of the table saw bed and is a view as seen from the operator's end.

FIG. 3 is a view showing the planar sharpening holder in operating position on the power saw bed and with operator's hands on gripping blocks as he pushes the sharpening holder lengthwise thus bringing the blade into contact with the rotating grinding wheel below.

DESCRIPTION OF A PREFERRED EMBODIMENT

Referring now to FIG. 1, there is at 1 a rectangular block resting on its left edge on the bed of table saw 2. There is at 3 a relief slot running the full length of block 1. At 4 there is a kerf running the full length of the block and cut into the block at the preferred depth and angle to properly hold the planar blade for engagement with grinding wheel.

There is a full length guide 6 extending below the planar blade sharpening holder to track inside of miter slot 7 in the bed of table saw 2.

Planar blade 9 is inserted into kerf 4 and tightened into place by thumbscrews 8.

FIG. 2 represents a cross-sectional view of the rectangular block planar blade sharpening holder 1 laying on top of bed of table saw 2. Rectangular block 1 contains a full length relief slot 3. Kerf 4, which runs the full length of block 1 is perfectly machined to retain planar blade 9 at chosen angle. Blade 9 is held firmly in place by thumbscrews 8. Block guide 6 engages miter slot 7. Grinding wheel 10 mounts on saw arbor 11.

Sharpening of blade 9 is accomplished by moving block 1 over table 2 to make lengthwise contact with grinding wheel at point 12.

Gripping block 13 provides raised surface and edge for hands of operator in order to move block 1 forward and back as grinder does its work.

In FIG. 3 the action of the planar blade sharpening holder 1 is shown being moved in sliding directions 14. Operators hands rest gently on gripping blocks 13 as grinder under the block makes continuous contact with planar blade being sharpened.

What I claim is:

1. A wood jointer and planar blade sharpening device consisting of:

a table saw, the table saw having a planar work surface, an elongated slot in the work surface to permit a tool to protrude through the slot, and an elongated groove spaced a distance from and parallel to the tool slot;

a tool consisting of a grinding wheel mounted in the table saw tool slot, the grinding wheel having an abrasive peripheral surface and a rotational axis, the grinding wheel positioned in the slot so that the rotational axis lies in a plane parallel to the work surface, the rotational axis perpendicular to the slot so that the peripheral surface of the grinding wheel extends a distance beyond the work surface; and a blade holder, the blade holder comprising:

a hand-held block means, the block means consisting of a base, the base having an upper surface and a lower surface; means for gripping the block mounted on the upper surface; a first groove means for holding the blade in proper position, the groove means being located on the lower surface, the groove means being formed with an angled slot to serve as a seat for the blade, second groove means located on the lower surface, the second groove means being coincident with the first groove means, the second groove means being wider than and shallower than the first groove means to allow the peripheral surface of the grinding wheel to contact the blade; and fastening means to securely fasten the blade in the angled slot of the first groove means, and guide means on the lower surface, the guide means fitting into the guide slot on the work surface of the table saw to guide the block and therefore the blade across the peripheral surface of the grinding wheel, to sharpen the jointer blade.

* * * * *